US010022026B2

(12) United States Patent
Price

(10) Patent No.: US 10,022,026 B2
(45) Date of Patent: Jul. 17, 2018

(54) HANDHELD PORTABLE VACUUM

(71) Applicant: Marc R. Price, Prairie Village, KS (US)

(72) Inventor: Marc R. Price, Prairie Village, KS (US)

( * ) Notice: Subject to any disclaimer, the term of this patent is extended or adjusted under 35 U.S.C. 154(b) by 168 days.

(21) Appl. No.: 15/070,978

(22) Filed: Mar. 15, 2016

(65) Prior Publication Data

US 2016/0309972 A1 Oct. 27, 2016

Related U.S. Application Data

(60) Provisional application No. 62/276,960, filed on Jan. 10, 2016, provisional application No. 62/179,022, filed on Apr. 27, 2015.

(51) Int. Cl.

| | |
|---|---|
| ***A47L 5/24*** | (2006.01) |
| ***A47L 9/28*** | (2006.01) |
| ***B08B 5/04*** | (2006.01) |
| ***A47L 9/14*** | (2006.01) |
| ***A47L 9/32*** | (2006.01) |
| ***A47L 9/24*** | (2006.01) |
| ***A47L 9/30*** | (2006.01) |
| ***E01H 1/08*** | (2006.01) |
| ***E01H 1/12*** | (2006.01) |

(52) U.S. Cl.

CPC ..... *A47L 5/24* (2013.01); *E01H 1/0836* (2013.01); *E01H 1/1206* (2013.01); *E01H 2001/1293* (2013.01)

(58) Field of Classification Search

CPC ..... A47L 5/24; A47L 9/244; A47L 9/2857; A47L 9/30; A47L 9/1427; A47L 9/322; A47L 5/04; E01H 1/1206; E01H 2001/1293

See application file for complete search history.

(56) References Cited

U.S. PATENT DOCUMENTS

| | | | | | |
|---|---|---|---|---|---|
| 4,979,330 | A * | 12/1990 | Rorant | A01M 1/06 | 43/139 |
| 5,052,147 | A * | 10/1991 | Broomfield | A01M 1/06 | 43/139 |
| 5,667,080 | A * | 9/1997 | Klein | A47L 5/24 | 209/235 |
| 6,202,343 | B1 * | 3/2001 | Mah | A01M 3/005 | 43/112 |
| 6,226,919 | B1 * | 5/2001 | Septer | A01M 1/06 | 43/139 |
| 6,640,489 | B1 * | 11/2003 | Boulton | A01M 1/06 | 43/139 |
| 6,799,350 | B1 * | 10/2004 | Gordon | A47L 5/24 | 15/1.51 |
| 2004/0194248 | A1 * | 10/2004 | Holtz | A47L 5/24 | 15/344 |
| 2007/0113371 | A1 * | 5/2007 | Cho | A47L 5/24 | 15/344 |

* cited by examiner

*Primary Examiner* — Dung Van Nguyen
(74) *Attorney, Agent, or Firm* — Law Office of Julie Scott LLC

(57) ABSTRACT

The present invention relates to a lightweight, portable vacuum that can be operated with a single hand. The invention provides improved means of collecting small objects, pet waste, dust, dirt, or other small debris without requiring excessive bending or stooping by the user. Advantageously, the invention provides improvements that reduce or potentially eliminate the user's contact with pet waste or other potentially hazardous solid waste.

18 Claims, 5 Drawing Sheets

HANDHELD PORTABLE VACUUM

BACKGROUND OF THE INVENTION

A. Field of the Invention

The present invention generally relates to a device for collecting pet waste, objects, debris, or other material. More specifically, the present invention relates to a vacuum-actuated device.

B. Description of the Related Art

Commonly, local laws, ordinances, or homeowners' associations require pet owners to remove and dispose of pet waste immediately or very soon after it is deposited. Even if a pet owner is not required by rule or regulation to remove pet waste, many pet owners prefer to remove it to maintain the cleanliness of their lawns, neighborhoods, and environment. Typically, pet waste is removed by using a bag, either with or without a shovel or scoop, to collect the waste. This activity requires the user to bend or stoop. This method is unpleasant and can result in the inadvertent transfer of waste to a user, which can be hazardous to the person's health. Further, because a plastic bag is often used, disposal can be environmentally detrimental.

Typically, devices for waste collection include shovels, scoops, bags, and other devices that require the user to have relatively good mobility and strength. Motorized devices are often heavy and/or bulky, difficult to transfer long distances, and require the user to have relatively good strength and flexibility. Even if the motorized devices are lighter in weight, each has its limitations. Commonly, motorized devices can be soiled during use and must be cleaned to eliminate undesirable odors and potential health risks from waste residue. Individuals that have arthritis, back pain, degenerative disc disease, coordination problems, poor eyesight, or other nerve or muscular problems that limit mobility can find cleaning up pet waste, debris, or other material by using such devices to be a particularly difficult task.

U.S. Pat. No. 7,984,530 discloses a pet waste vacuum system that can use disposable liners; however, the apparatus must be partially disassembled to remove the liner and waste, which makes the task less pleasant and difficult for those having limited mobility, flexibility, or eyesight.

SUMMARY OF THE INVENTION

Individuals having diminished mobility or strength, or visual impairment(s) can find daily tasks challenging. Individuals attempting to multi-task, e.g hold onto a pet's leash and collect the pet's waste, may find that their range of motion is inhibited. The present invention provides compositions and methods relating to an improved handheld, portable vacuum. The invention provides a relatively lightweight vacuum that can be operated with one hand and is designed to collect a variety of objects or solid animal waste. The vacuum is designed so that a user does not need to bend, reach, or stoop excessively. Reducing the need to bend, reach, or stoop is useful to individuals having limited mobility, diminished strength, or impaired eyesight.

The vacuum is designed so that when animal waste is collected the device and user have little or no direct, physical contact with the waste during collection and disposal. Reducing exposure to animal waste can help to reduce health risks and make a necessary task less unpleasant.

Advantageously, the same vacuum device can be used to collect objects, particularly small or lightweight objects, without excessive stooping, reaching, or bending. Thus, the devices of the invention are particularly suitable for use by individuals having limited mobility, diminished strength, or impaired eyesight such as the aged, blind, or chronically ill (e.g. diabetics).

The invention provides a portable vacuum device comprising a handle, a motor having a fan, and a tube. The motor is housed in the handle. The tube is attached to the handle, and the tube includes an intake port that is located distally to the handle, a first filter guard, and a collection compartment. The collection compartment is in the half of the tube nearest to the intake port, more preferably the collection compartment is located in the third, and even more preferably the quarter, of the tube nearest to the intake port. The first filter guard is located between the first collection compartment and the handle. The vacuum device is operable with one hand.

The motor includes a battery or an electric cord, preferably the motor operates by using one or more batteries. One or more fans may be included in or adjacent to the motor.

Preferred embodiments of the invention include a second filter guard that is located in the half of the tube most adjacent to the handle.

Portable vacuum devices of the invention include either a telescoping tube or a tube that does not fold or collapse.

Embodiments of the invention include a tube that has an attachment area for a collection bag that fits into the collection compartment. The attachment area is located on the exterior of the tube that is adjacent to the intake port, and the attachment area has a circumference that is greater than the circumference of the exterior portion of the tube adjacent to the attachment area. Preferably, the attachment area is curled, winged, pronged, or otherwise folded away from the input port such that a collection bag can cover or overlap the attachment area, and the bag will remain in place when vacuuming. The attachment area may include tacky material, adhesive, hook(s), prong(s), or other means suitable for keeping a bag in place during vacuum operation.

Portable vacuum devices of the invention can further include a means to collect objects without operating a vacuum. Such embodiments have a means that substantially surrounds the exterior tube adjacent to the intake port, and the means comprises a tacky material, adhesive, bristle, fiber, brush, magnet, or any combination thereof.

Preferably, handles of the vacuum devices include an operating mechanism that is an on/off mechanism, a reverse mechanism, a light switch, or any combination thereof. Handles may include a scent compartment, a wrist strap, reflector, light, or any combination thereof.

Portable vacuum devices of the invention may include a tube that has a scent compartment, reflector, light, or any combination thereof.

Certain embodiments of the invention further comprise a floor attachment that has an intake opening, a second collection compartment, and a connector space to which the distal end of the tube (i.e. the end of the tube having the intake port) attaches such that during operation of the motor air flows through the tube and the floor attachment such that a pressure change occurs.

Preferably, the floor attachment includes an opener to access the second collection compartment. The floor attachment may also include a wheel, a roller, a connector for a carrying means (e.g. a strap), a reflector, a scent compartment, or any combination thereof.

Certain floor attachments of the invention are particularly intended to be useful for the collection of solid pet waste. Preferably, these floor attachments are configured so that a collection bag can be fitted into the floor attachment and extended through the intake opening and over a portion of the exterior of the floor attachment to reduce, or even eliminate, physical contact between the vacuum device and the pet waste.

Preferred floor attachments are configured so that a front portion of each side of the floor attachment is broader than an adjacent rear portion of each side of the floor attachment and together the broader front portions of the sides form a connecting region for a collection bag that inserts into the collection compartment of the floor attachment.

Preferred floor attachments of the invention further include a molded depression into which the tube can at least partially rest when the device is not in use. If a telescoping tube is present, then preferably the molded depression accommodates the telescoped tube in a collapsed position, preferably a fully collapsed position so that vacuum devices of the invention can be reduced in size for storage, carrying, or shipping.

The invention provides a method of collecting objects using a vacuum device.

The invention also provides a method of collecting solid animal waste comprising using a vacuum device with a collection bag. Those of skill in the art will recognize that the embodiments of the invention described as being suitable for the collection of solid pet waste may also be useful for the collection and disposal of many other solid, or semi-solid, wastes with which it is desirable to avoid physical contact.

Certain embodiments of the invention operate by using a motor having a battery(ies). In other embodiments the motor may be operated with an electrical cord. Preferred motors have one or more fans. The motor may be located in multiple positions, such as either along a side, at or near the bottom of the device, or at or near the top of the device. It is preferred that the motor is located adjacent to, or more preferably within, the handle area. If the motor is battery-operated, then preferably the battery(ies) is located in or adjacent to the handle area. If the motor is operated with an electrical cord, then preferably the cord is retractable and located in or adjacent to the handle area. Those of skill in the art will recognize that a wide variety of motors suitable for use in the invention are available. It is expected that any suitable motor, battery, or cord may be used in the invention.

Embodiments of the invention may be vented so that air circulates within or through the device. Preferably, air circulates within or through at least the compartment in which material is collected. This compartment may be either a collection compartment or a waste compartment containing a bag to hold collected waste.

When the motor is located within the handle area, preferably the handle is vented. Either single or multiple vents may be present in the handle. The number of vents present will, in part, be determined by the size of the vent(s), the amount of air circulation that is required for a motor and/or fan to operate, and the amount of air circulation required to create suction to collect material into the device's compartment. Those of skill in the art will be familiar with the principles governing vacuum technology and how to determine the number and size of the vents.

Advantageously, certain embodiments of the invention that are useful for the vacuum collection of objects are designed so that when the vacuum is not operating, then the collected objects are retained within the device. These embodiments include a tube closure, such as a flap, fold, or other suitable means known in the art, that attaches to the tube and is adjacent to the intake port. When the vacuum device is not in operation, the tube closure covers the intake port. When a vacuum force is applied, or the user operates an opener-closer, then the tube closure is held or forced against the interior of the tube such that objects can be sucked into the collection compartment. When the vacuum force is removed, or the user operates the opener-closer, then the tube closure returns to its resting position and covers the intake port such that collected objects stay in the collection compartment. Alternatively or additionally, a bag can be placed in the collection compartment to hold vacuumed objects. A bag having vacuumed objects either may be removed from the device or left in the compartment and portions of the bag that are exterior to the collection compartment can be tucked into the compartment.

When the user wishes to remove the objects, the user can operate a switch, button, lever, or other release mechanism on, contiguous with, adjacent to, or near the handle to open the device, or preferably the compartment containing the object, and either allow gravity to cause the objects to empty, or drop, from the collection compartment, or alternatively, cause the air flow in the device to reverse and forcibly expel the objects. By locating a release mechanism on, contiguous with, adjacent to, or near the handle area, the user has the opportunity to operate the device with a single hand. Alternatively or additionally, a release mechanism may be located in the distal half of the device closer to the collection compartment.

Embodiments of the invention may include a means to collect objects without operating the vacuum. Preferably, the means is attached to the device near or adjacent to the opening through which objects move into a collection compartment of the device. The means may be a tacky material, adhesive, bristle, fiber, brush, magnet, or combination thereof. Preferably, the means includes one or more magnets so that a user may easily separate metallic and non-metallic objects. The means may be any shape or size suitable for attachment near or adjacent to the collection opening. Most preferably, the means includes one or more magnets immediately adjacent to and substantially surrounding the collection opening.

Preferred embodiments of the invention are made primarily of plastic or other lightweight materials. Those of skill in the art will be familiar with the wide variety of materials that are suitable for the manufacture of various components of the invention. Those of skill in the art will also appreciate that preferred embodiments of the invention will be relatively lightweight. More specifically, embodiments of the invention are expected to weigh less than 15 lbs., preferred embodiments weigh less than 10 lbs., more preferably less than 9, 8, 7, or 6 lbs., and most preferably less than 5 lbs.

Before describing the present invention in detail, it is to be understood that this invention is not limited to the exemplary embodiments. Other objects, features and advantages of the present invention will become apparent from the following detailed description. It should be understood, however, that the detailed description and specific examples, while indicating preferred embodiments of the invention, are given by way of illustration only, since various changes and modifications within the spirit and scope of the invention will become apparent to those skilled in the art from this detailed description. It is also to be understood that the terminology used is for the purpose of describing particular embodiments of the invention and is not intended to be limiting. It must be noted that, as used in this specification and the attached claims, the singular forms "a", "an" and "the" include plural referents unless the content clearly dictates otherwise.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

DETAILED DESCRIPTION

The invention provides a relatively lightweight, handheld vacuum especially designed to pick up solid animal waste or objects, preferably small objects such as pins, fasteners, buttons, paper, hearing aids, lightweight objects of various size, etc., without requiring that the user unduly bend, reach, or stoop to operate the vacuum. Objects that the invention can collect may be either metallic or non-metallic. Advantageously, the vacuum is designed so that it can be operated with one hand. Some embodiments of the invention can be compacted for storage, shipping, carrying, or easier transport.

Embodiments of the invention that are particularly suitable for collection of solid animal waste are advantageously designed so that both the device and the user's physical contact with the animal waste is reduced, or even eliminated. By reducing, or even eliminating, physical contact with animal excrement little or no cleaning of the device or user are required after use.

When the invention is used to collect objects a bag may or may not be used. Those of skill in the art will appreciate that when a user is using a device of the invention to collect dust, debris, or other material intended for disposal, then a user may prefer to use the device with a bag. Such a bag may be made of plastic, paper, cloth, filter material, or any combination thereof. An environmentally safe bag is preferred. Alternatively, a user may prefer to collect material, e.g. buttons, screws, coins, etc., without a bag.

Figure 1:
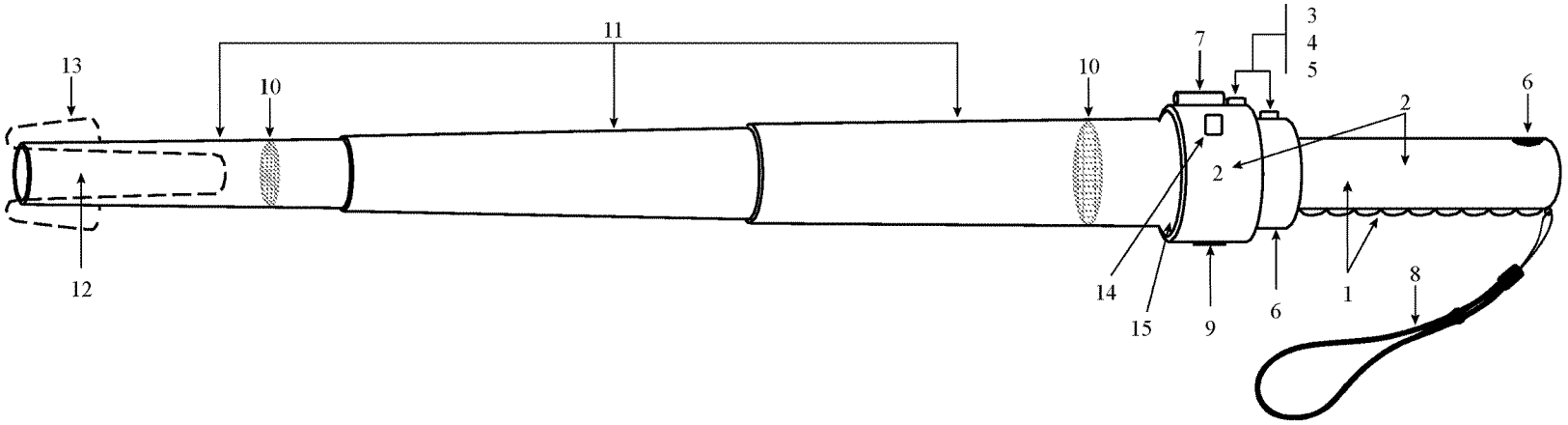
FIG. 1. shows a diagram of one embodiment of the invention with an exemplary arrangement for a waste filter bag.
Figure 2:
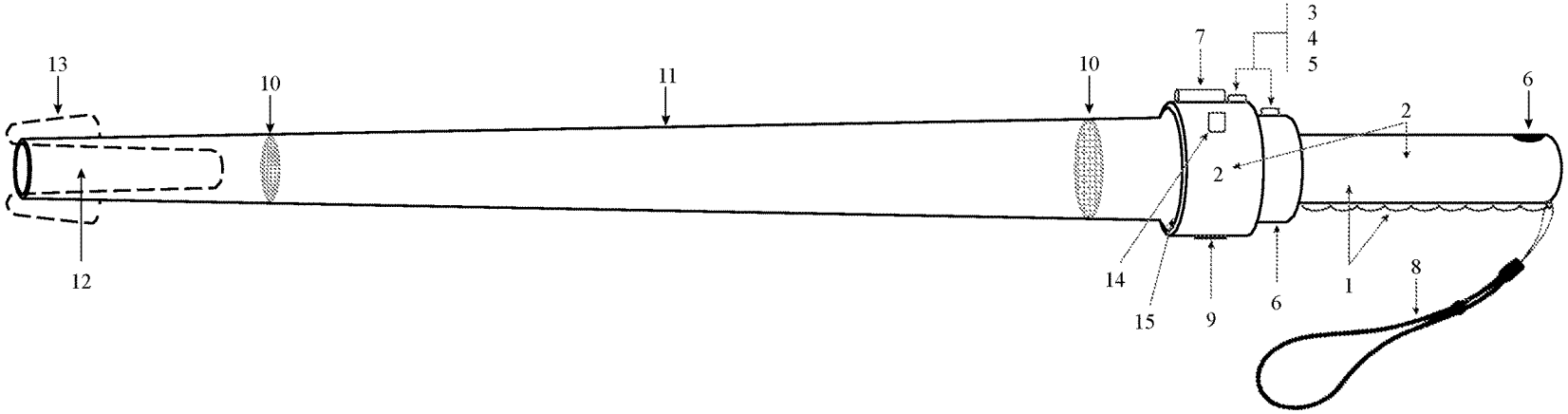
FIG. 2 shows a diagram of another embodiment of the invention with an exemplary arrangement for a waste filter bag.

FIGS. 1 and 2 illustrate two embodiments of the invention. FIG. 1 shows an embodiment in which the vacuum includes a tube (11) that is telescopic and may be retracted or collapsed when the vacuum is not in use. FIG. 2 shows a device having a tube (11) that is not retractable or collapsible. During vacuum operation, air flows from the distal opening of the tube (11) (i.e an intake port) towards the handle (1) with enough force to create sufficient suction to collect material into the tube (11). Those of skill in the art will be familiar with the principles of vacuum technology and understand that the length of the tube, the size of the intake port, the force generated by the motor will, and rate of air flow will all effect the amount of suction that is created by the device.

To prevent collected material from travelling the entire length of the tube (11) towards the handle (1), one or more filter guards (10) are present in the tube (11). Preferably at least one filter guard (10) is located, relative to the handle (1), in the distal half, third, or even the most distal quarter of the tube (11). And, preferably another filter guard (10) is located in the half, third, or even the quarter of the tube (11) most adjacent to the handle (1). When not in use, the distal end of the tube (11) may be covered by an end cap.

When a bag is used in an embodiment similar to either FIG. 1 or 2, then the bag (13) is placed in a waste compartment (12) at the most distal portion of the tube (11) relative to the handle (1). Preferably, a portion of the bag (13) overlaps onto the exterior of the distal end of the tube (11) so that material, such as animal waste, does not contact the device during use. It is also preferred that the bag extends sufficiently over the exterior of the distal portion of the tube so that the user can reduce, or even eliminate, contact with collected material, such as animal waste, when removing the bag from the device. Preferred bags are environmentally safe and biodegradable. Preferred bags also have a fastener, such as elastic or other flexible material, that acts to hold the bag in place during vacuum operation. Such fasteners also may act to close a filled bag. Those of skill in the art will be familiar with the many suitable means for closing a bag. Preferred fasteners are pull tabs or have sticky ends. Preferred bags allow air to pass through them.

The exterior of the distal end of the tube (11) is shaped to help fix in place the portion of the bag (13) that extends over the exterior of the tube (11). The exterior of the distal end of the tube may be shaped in a variety of ways to help the bag to stay in place. For example, the exterior of the distal end of the tube may be curled, have flaps or wings, folded outward, or otherwise shaped or molded so that when a bag overlaps the shaped or molded area, then the bag is less able to slip off of the tube as compared to a tube lacking such shaping or molding.

Adjacent to the filter guard (10) in the tube (11) most proximal (i.e. nearest) to the handle (1) is a scent compartment (15). Preferably, the scent compartment is adjacent to, or more preferably within the handle (1). The scent compartment (15) may contain any variety of materials that are useful for reducing offensive odors that are often associated with pet waste. Preferably, the material used to control odors is lightweight and environmentally safe. Optionally, an opening (not shown) in the tube (11), handle (1), or preferably the scent compartment (15) provides access to the material used to control odor so that it can be replaced as desired.

So that a user can operate the vacuum with one hand, operating mechanisms for the vacuum are located near, in, or on the handle area. An exemplary arrangement of the operating mechanisms is shown in FIGS. 1 and 2. Those of skill in the art will understand that many different arrangements of the operating mechanisms can be made. Preferred arrangements are those that are easy for multiple different users to operate. For example, an on/off switch or button (3), light switch (4) to operate a light (7), and reverse switch or button (5) may be located on an upper, bottom, or side surface of the handle (1). The operating mechanisms may be adjacent to each other or separated onto different surfaces of the handle (1). Preferably, the light (7) is an LED light that operates in the visible light range so that a user can collect material in dim light or in the dark.

Optionally, a wrist strap (8) may be attached to the handle (1) for easier carrying. Either in addition to or in place of a wrist strap, a magnet, clip, or hook (9) may be on the side of the handle (1) so that device can be easily stored or carried (e.g. on a wheelchair, walker, or in a closet). Optionally, one or more reflectors (14) may be present on the side(s) of the handle (1) or tube (11) so that the vacuum may be operated with greater safety at night. One or more reflectors (14) may be placed on the distal portion of the tube (11) so that a user may more easily identify the opening to the waste compartment (12).

The vacuum operates by using a motor having a battery (ies) or an electrical cord. While the motor may be located within the device in multiple positions, such as either along a side of the tube (11), or at or near the bottom or top of the device, it is preferred that the motor is located within the handle (1) so that the device's weight is better balanced for the user. While the motor is not shown in the accompanying figures, the preferred region (2) of the handle (1) within which the motor is placed is identified. If the motor is battery-operated, then preferably the battery(ies) is located in or adjacent to the handle (1), most preferably the battery (ies) is located in the preferred region (2) of the handle (1). If the motor is operated with an electrical cord, then preferably the cord is retractable and located in the preferred region (2) of the handle (1) or adjacent to it. Preferably, one or more vents (6) are located near the motor. The motor may include a fan (not shown).

The bag (13) can be composed of any suitable material(s). Preferably, the bag (13) is environmentally safe, such as a paper bag. Preferred bags (13) are composed at least partially of paper, other filter material, or a combination thereof so that when the vacuum is operated air can flow through the bag and into the tube (11). One or more air vents may be located along the tube near the waste compartment or near the motor. Exemplary vents (6) are shown near the top of the device in the handle area in FIGS. 1-3.

Figure 3:
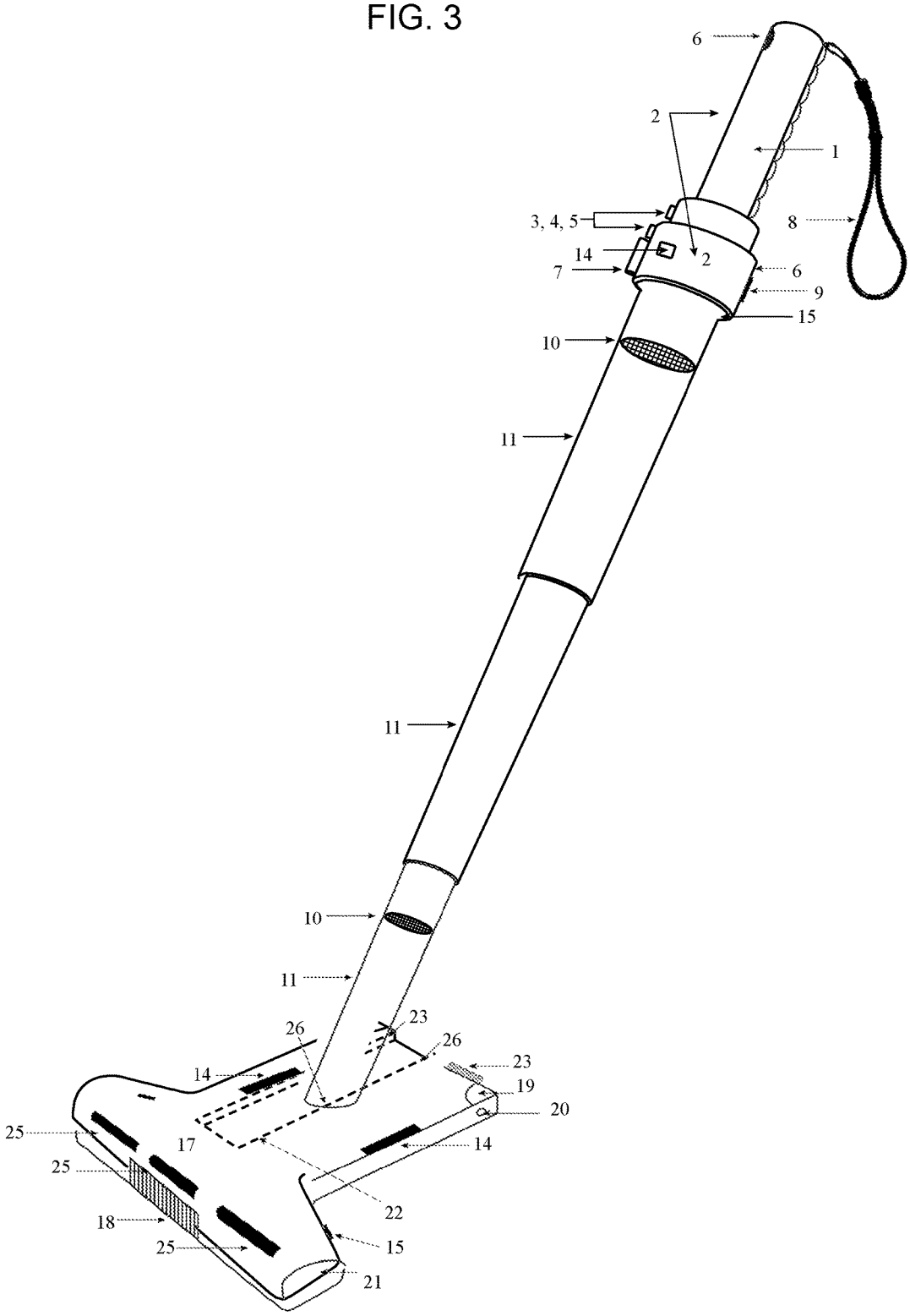
FIG. 3 shows a diagram of an embodiment of the invention that includes a floor attachment having a waste compartment.
Figure 4:
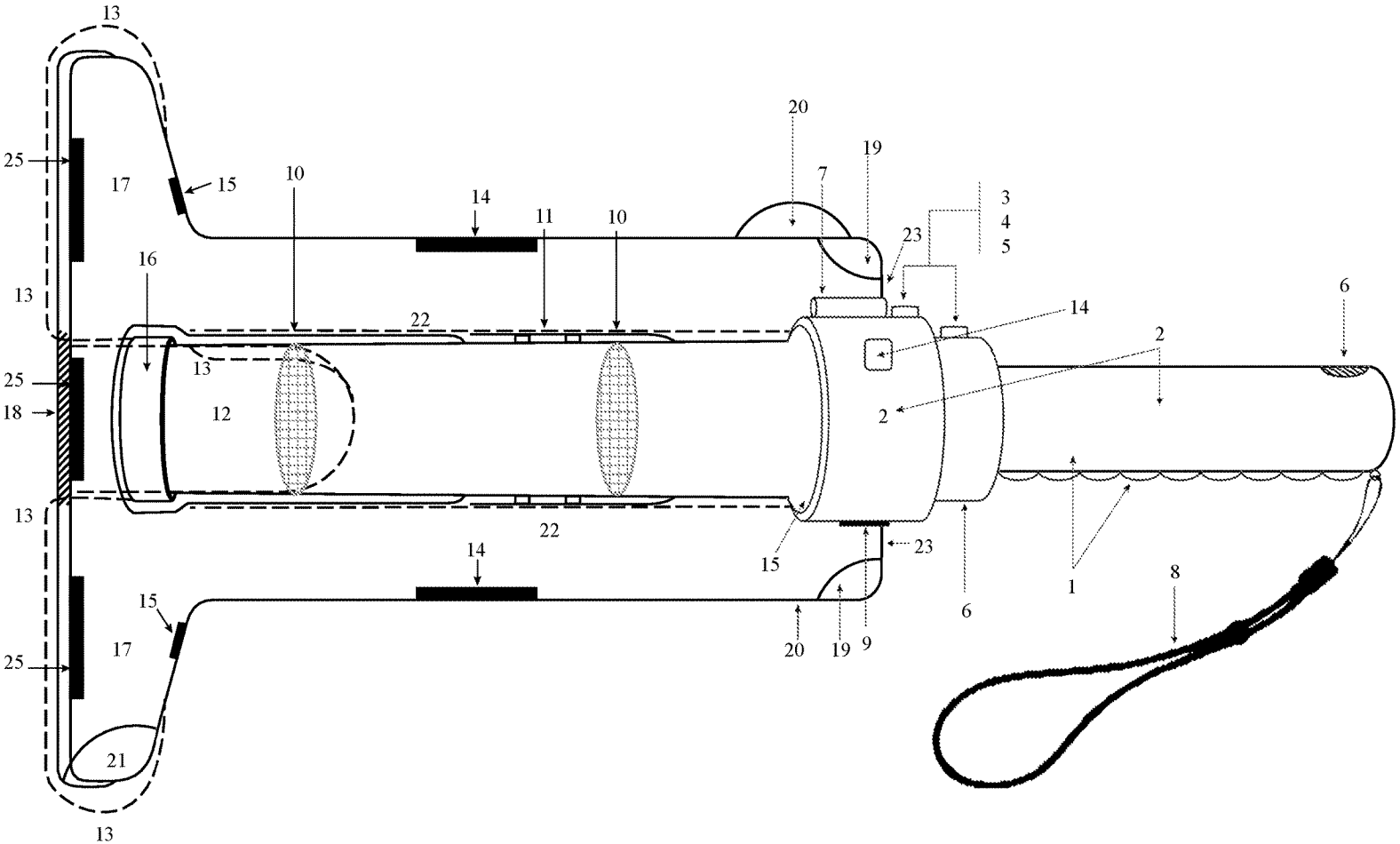
FIG. 4 illustrates an embodiment of the invention with a floor attachment in position for storage, shipping, or carrying.
Figure 5:
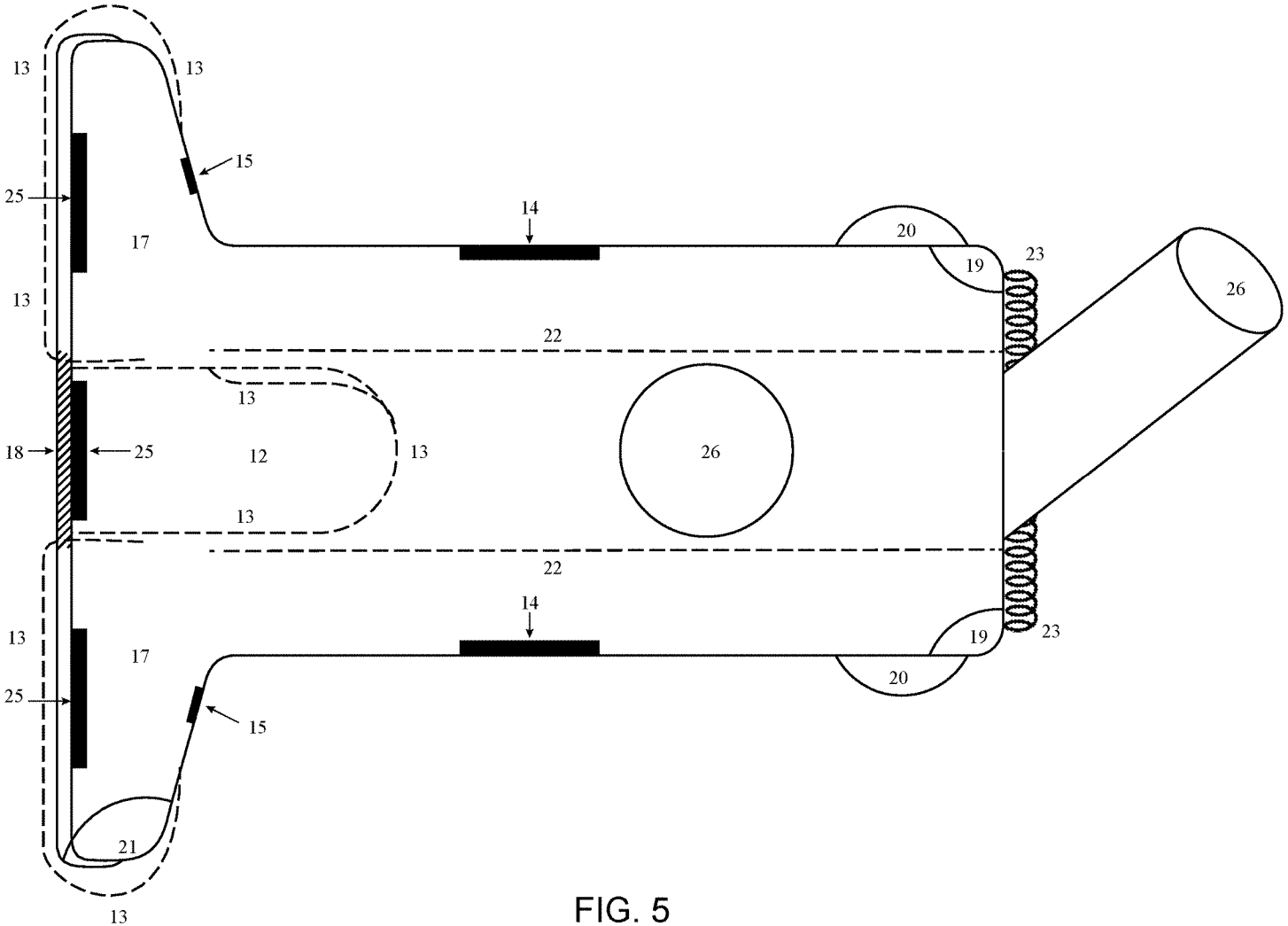
FIG. 5 illustrates further details of a floor attachment.

A third embodiment of the invention is illustrated in the FIGS. 3-5. This embodiment includes the features of the other described embodiments of the invention and some additional features. Specifically, this embodiment allows the user to reconfigure a handheld vacuum into a floor vacuum by adding a floor attachment. The reconfigured vacuum is suitable for collecting material, preferably lightweight material such as dust, dirt, small debris, or objects, preferably small objects such as pins, fasteners, buttons, stamps, hearing aids, and other lightweight objects of various size.

FIG. 3 illustrates the invention reconfigured into a floor vacuum. The most distal end of the tube (11) attaches to the floor attachment at approximately either connecting position (26) (see FIGS. 3 and 5). Preferably, the tube (11) may insert, snap, or twist into a connecting position (26). Skilled artisans will understand that the tube (11) can placed into a connecting position (26) through any number of readily available means.

Preferably, the floor attachment includes one or more lights (25) on or near the front of the floor attachment. Optionally, one or more lights (not shown) may be located along the top or sides of the floor attachment.

Material is collected through an opening (18) that is located on the front side of the floor attachment and adjacent to a floor or surface on which the attachment is resting. The opening (18) may extend partially onto the bottom surface of the floor attachment. The specific location and shape of the opening (18) may be varied somewhat so that a floor attachment may be especially designed to pick up particular types of materials.

Vacuumed material, such as waste or an object, is collected in a waste compartment (12) located inside the floor attachment (see FIGS. 4 and 5, dotted line). The waste compartment is accessed by removing or opening the top or lid (17) of the floor attachment with an opener (21). Preferably, the opener (21) is located on a front portion of the lid (17). The opener (21) is a switch, or more preferably a button, that can be easily operated with the user's foot, hand, or finger(s) to open the lid (17). The lid (17) may be held in place by molded tabs, strips, or other similar molded indentations, or one or more hinges. If the lid (17) is hinged then one or more hinges (23) may be located either on a side, or preferably along the back, of the floor attachment. The lid (17) can be closed by simply pressing it back into position for use.

In some embodiments of the invention a bag may be placed in the compartment to contain collected material. The bag may be made of any suitable material such as plastic, cloth, paper, or any combination of such materials. Preferably, the bag is paper, and more preferably, the bag is composed of a filter paper so that air can flow through the bag. Alternatively, a user may use the floor vacuum without a bag in the compartment. When a bag (13) is placed in the compartment (12), preferably the bag (13) extends outside of the compartment and over a portion of the front of the floor attachment. More preferably, the front of the floor attachment is configured to be wider along its lateral edges relative to the rest of the floor attachment so that the bag (13) extends over the lateral edges and better protects the device from contacting waste or other material (see FIGS. 4 and 5).

Optionally, the floor attachment may have a wheel(s) or roller(s) (20), or a connector (19) for a shoulder strap or other carrying means. In addition, the floor attachment may have one or more safety reflectors (14) located along its top, side(s), front, and/or back. One or more scent compartments (15) may also be present on the floor attachment. If a scent compartment is present then preferably a means of opening the scent compartment is included so that the material used to control or mask odor can be replaced. An end cap (16) may be included to cover the distal end of the tube (11).

When not in use, the floor attachment includes a molded depression (22) into which the tube (11) can be folded or collapsed so that the vacuum takes up less space when stored or carried. Preferably, when the tube (11) is telescopic, the tube (11) can be reduced in size and fit into the molded depression (22). One configuration of the folded vacuum is shown in FIG. 4. Advantageously, when the collapsed tube (11) is folded into the floor attachment, the size of the entire device is greatly reduced so that it can be easily carried, shipped, or stored.

Unless defined otherwise, all technical and scientific terms used herein have the same meaning as is commonly understood by one of skill in the art to which this invention belongs at the time of filing. The meaning and scope of terms should be clear; however, in the event of any latent ambiguity, definitions provided herein take precedent over any dictionary or extrinsic definition. Further, unless otherwise required by context, singular terms shall include pluralities and plural terms shall include the singular. Herein, the use of "or" means "and/or" unless stated otherwise. Furthermore, the use of the term "including", as well as other forms such as "includes" and "included" is not limiting. All patents and publications referred to herein are incorporated by reference herein.

Unless defined otherwise, all technical and scientific terms used herein have the same meaning as is commonly understood by one of skill in the art to which this invention belongs at the time of filing. All patents and publications referred to herein are incorporated by reference herein.

All of the compositions and methods disclosed and claimed herein can be made and executed without undue experimentation in light of the present disclosure. While the compositions and methods of this invention have been described in terms of preferred embodiments, it will be apparent to those of skill in the art that variations may be applied to the compositions and methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the following claims.

What is claimed is:

1. A portable vacuum device comprising a) a handle;

b) a motor having a fan, wherein the motor is housed in the handle; and c) a tube that is attached to the handle, and the tube includes an intake port that is located distally to the handle, a first filter guard, and a first collection compartment, wherein the first collection compartment is in the half of the tube nearest to the intake port, and the first filter guard is between the first collection compartment and the handle, wherein the vacuum device is operable with one hand and the exterior of the tube adjacent to the intake port comprises an attachment area for a collection bag that inserts into the first collection compartment.

2. The portable vacuum device of claim 1, wherein the motor includes a battery or an electric cord.

3. The portable vacuum device of claim 1, wherein a second filter guard is located in the half of the tube most adjacent to the handle.

4. The portable vacuum device of claim 1, wherein the tube is a telescoping tube.

5. The portable vacuum device of claim 1, wherein the circumference of the attachment area is greater than the circumference of the exterior portion of the tube adjacent to the attachment area.

6. The portable vacuum device of claim 1, wherein the attachment area is curled, winged, pronged, or folded away from the input port.

7. The portable vacuum device of claim 1, wherein the tube further includes a means to collect objects without operating a vacuum, wherein the means substantially surrounds the intake port and comprises a tacky material, adhesive, bristle, fiber, brush, magnet, or any combination thereof.

8. The portable vacuum device of claim 1, wherein the handle further includes an operating mechanism.

9. The portable vacuum device of claim 8, wherein the operating mechanism is an on/off mechanism, a reverse mechanism, or a light switch.

10. The portable vacuum device of claim 1, wherein the handle further includes a scent compartment, a wrist strap, reflector, light, or any combination thereof.

11. The portable vacuum device of claim 1, wherein the tube further includes a scent compartment, reflector, light, or any combination thereof.

12. The portable vacuum device of claim 1, wherein the tube further includes a tube closure adjacent to the intake port that covers the intake port when the vacuum device is not in operation, and when a vacuum force is applied then the tube closure is forced against the interior of the tube such that objects can be sucked into the collection compartment.

13. A portable vacuum device comprising a) a handle;

b) a motor having a fan, wherein the motor is housed in the handle;

c) a tube that is attached to the handle, and the tube includes an intake port that is located distally to the handle, a first filter guard, and a first collection compartment, wherein the first collection compartment is in the half of the tube nearest to the intake port, and the first filter guard is between the first collection compartment and the handle; and d) a floor attachment that has an intake opening, a second collection compartment, and a connector space to which the distal end of the tube attaches such that during operation of the motor air flows through the tube and the floor attachment such that a pressure change occurs wherein the vacuum device is operable with one hand.

14. The portable vacuum device of claim 13, wherein the floor attachment further includes an opener to access the second collection compartment.

15. The portable vacuum device of claim 13, wherein a front portion of each side of the floor attachment is broader than an adjacent rear portion of each side of the floor attachment and together the broader front portions of the sides form a connecting region for a collection bag that inserts into the second collection compartment.

16. The portable vacuum device of claim 13, wherein the floor attachment further includes a molded depression into which the tube can at least partially rest.

17. The portable vacuum device of claim 13, wherein the floor attachment further includes a wheel, roller, connector for a carrying means, a reflector, a scent compartment, a light, or any combination thereof.

18. A method of collecting solid animal waste comprising using a vacuum device, wherein the vacuum device has a handle; a motor having a fan, wherein the motor is housed in the handle; a tube attached to the handle, wherein the tube has an intake port that is located distally to the handle; a first filter guard; and a first collection compartment, wherein the first collection compartment is in the half of the tube nearest to the intake port, and the first filter guard is between the first collection compartment and the handle; and a collection bag.

* * * * *